US005868902A

United States Patent [19]

Howland et al.

[11] Patent Number: 5,868,902

[45] Date of Patent: Feb. 9, 1999

[54] SECURITY PAPER

[75] Inventors: Paul Howland; Jonathan Paul Foulkes, both of Andover, United Kingdom

[73] Assignee: Portals Limited, London, United Kingdom

[21] Appl. No.: 875,734

[22] PCT Filed: Mar. 11, 1996

[86] PCT No.: PCT/GB96/00562

§ 371 Date: Sep. 10, 1997

§ 102(e) Date: Sep. 10, 1997

[87] PCT Pub. No.: WO96/28610

PCT Pub. Date: Sep. 19, 1996

[30] Foreign Application Priority Data

Mar. 13, 1995 [GB] United Kingdom ..... 9505062
Nov. 22, 1995 [GB] United Kingdom ..... 9523838

[51] Int. Cl.[6] ..... D21H 19/24; D21H 21/40

[52] U.S. Cl. ..... 162/140; 162/134; 162/135; 162/136; 162/137; 283/57; 283/73; 428/211; 427/361

[58] Field of Search ..... 162/103, 140, 162/134, 135, 136, 137; 283/57, 58, 59, 73; 428/206, 207, 208, 211; 427/258, 361, 391

[56] References Cited

U.S. PATENT DOCUMENTS 3,880,706 4/1975 Williams ..... 162/103
4,462,866 7/1984 Tooth et al. ..... 162/103
5,232,527 8/1993 Vernhet et al. .
5,660,919 8/1997 Vallee et al. ..... 428/206

FOREIGN PATENT DOCUMENTS 0185184 6/1986 European Pat. Off. .
0599675 6/1994 European Pat. Off. .
4336214 4/1994 Germany .
2170501 8/1986 United Kingdom .

OTHER PUBLICATIONS

International Patent Publication No. WO 91/12372, issued 22 Aug. 1991 to A. Vallee et al., for "Sheet for Protected Documents Having High Printability and High Handling Resistance."

Abstract of JP 06145598A (Dainippon Ink & Chem. KK) entitled "Polyurethane Coating Agent . . . for Coating Plastic Films or Sheets".

*Primary Examiner*—Stanley S. Silverman
*Assistant Examiner*—José A. Fortuna
*Attorney, Agent, or Firm*—Watson Cole Grindle Watson, P.L.L.C.

[57] ABSTRACT

The present invention relates to a method for producing security paper which includes a security feature. The method comprises forming paper in a wet state, which paper incorporates on or more security features, applying to the paper a sizing agent, thereafter applying to one or both sides of the sized paper a coating comprising an unpigmented polyurethane. The unpigmented polyurethane may optionally comprise a functional additive provided that the presence of the functional additive does not increase the opacity of the paper by more than 1%. After the polyurethane has been applied the paper is dried. The coating composition provides a film, when cast on a glass surface, having a König hardness of from 15 to 130 seconds.

18 Claims, No Drawings

SECURITY PAPER

This application is a 371 of PCT/6B96/00562 filed Mar. 11, 1996.

BACKGROUND OF THE INVENTION

Field of The Invention

This invention is concerned with paper for security documents, and more particularly to those documents which are subject to considerable amounts of handling such as banknotes and driver's licenses.

It is important that security documents, e.g., banknotes and drivers' licenses, be durable; in other words, resistant to tearing, fold damage and soiling. Moisture and chemicals absorbed by such security documents during handling can lead to physical degradation. It is desirable that the substrate for such security documents be resistant to absorption. And it is, of course, a prime requirement for such security documents that the print which is applied to the substrate should adhere well, especially under severe conditions involving mechanical abrasion or accidental laundering.

The Prior Art

Security documents of the kind with which this invention is concerned incorporate one or more visible security features to prevent or deter counterfeiting. Included in the security features which may be used are watermarks and security threads present in the paper. Security threads may be disposed entirely within the paper or may appear in so-called windows located between regions where the thread is positioned between the surfaces of the paper, for example as present in the Bank of England Series E banknotes. It is normal in security documents for the substrate to be of good quality to enable satisfactory embossing to be achieved, such as embossing produced by the known Intaglio printing and to ensure good wear properties.

Previous proposals to provide paper for security documents which have good soil resistance and durability have involved the use of coating compositions which incorporate a pigment together with a binder such as an elastomeric binder. It is also known generally that various polyurethane compositions can be used on a wide variety of substrates to provide coatings which have a protective effect of one kind or another; amongst such uses, polyurethanes have been employed as a varnish for wood or other substrates. Also, it is know from European Patent EP-B-189945 to use polyurethane compositions as sizings for paper.

In the case where a coating composition involving a pigment is used for the production of security paper, e.g., as in PCT application No. WO91/12372, such pigment usually has a benefit in providing micro-porosity or roughness which enables satisfactory ink keying to be achieved. However, there is a serious disadvantage resulting from the presence of a pigment, namely that a security feature such as a watermark or windowed thread present in the substrate is to some extent obscured.

Pigmented coatings are inherently weak resulting from the presence of the pigment which causes the binder to be less firmly attached to the substrate in specific locations.

Usually, when pigmented coating compositions are used, the coating step takes place after the paper has been produced, and this involves the disadvantage of having to dry the paper before application of the coating composition. The prior specification EP-B-189945 refers to sizing, and it will be noted later that the present invention is concerned with the use of a polyurethane composition applied to security paper after the paper has been sized with a natural or synthetic sizing agent. Furthermore, it is an essential feature of the coating composition of this invention that no pigment is present so that there is no obscuring of any security feature. However, as will be described below, various functional additives may be present in the polyurethane coating provided that the opacity of the paper is not increased by more than 1%.

The present invention has resulted after extensive investigations by the inventors with the object of producing security documents which have enhanced durability and resistance to soiling.

SUMMARY OF THE INVENTION

According to the present invention there is provided a method for producing security paper which includes a security feature, which method comprises forming paper in a wet state, the paper incorporating one or more security features, applying to the paper a sizing agent, thereafter applying to one or both sides of the sized paper a coating comprising an unpigmented polyurethane which may optionally comprise a functional additive, provided that the presence of the functional additive does not increase the opacity of the paper by more than 1%, thereafter drying the paper, the coating composition being such as to provide a film, when cast on a glass surface, having a König hardness of from 15 to 130 seconds, and also passing the water resistance test as defined by the following steps:

a) The total formulation to be used in the coating is cast on a glass plate so as to produce a film with a dry weight of 80 g/m$^2$.
b) The film is initially dried at 23° C. Once it is tack free it is dried for an additional hour at 80° C.
c) The film is weighed before being wetted and tested for tensile strength, Young's Modulus and is visually checked for any change in its transparency.
d) A sample of the film is boiled in water containing 10 g/litre $Na_2CO_3$ for 30 mins.
e) The film is then rinsed in cold water and the steps b) to c) are then repeated. The film is dried and re-weighed.

The tested film is categorised as water resistant if it meets the following criteria:

i) The wet tensile strength and Youngs Modulus of the boiled film is not less than 90% of the initial film wet tensile strength and Young's Modulus.
ii) The film shows no perceptible loss of transparency.
iii) The dried weight of the film is not less than 98% of the original weight.

Research has demonstrated that the above test enables satisfactory polyurethane coating to be identified for the purpose of the present invention.

The aqueous polyurethane may be in the form of an aqueous dispersion. The coating may incorporate an extender such as a polyacrylate and hence be in the form of a urethane-acrylic blend; such a blend must provide good water and chemical resistant coatings. Also, the low cost of an extender relative to that of the polyurethane results in the blend being considerably less costly than the polyurethane alone.

The coating may be a polyurethane dispersion with a one component pre-crossed-linked polyurethane or with a one component, blocked polyurethane which has isocyanate groups chemically bound to the polymer chains but which isocyanate groups are regenerated at those elevated temperatures which are generally used in the final stages of a paper-making process. Furthermore, the coating may be a polyurethane dispersion of a two-component product which can be cross-linked by using multi-functional reagents such as a melamine/formaldehyde precondensate. Cross-linking agents which may be used include polyaziridines. Cross-linking agents enhance the water resistance including laundry resistance of the unpigmented polyurethane coating to provide improved security paper and documents produced therefrom.

A polyurethane composition for use in the method of this invention may include ingredients known to those skilled in the art including catalysts, co-solvents and emulsifying agents or surfactants. Care has to be taken, however, because an emulsifying agent can detract from the performance of the coating under wet or humid conditions. Additionally, other known additives may be used including defoamants, flow additives, thickeners or viscosity modifiers. In general an additive included in the coating composition should be kept to a minimum as important properties such as adhesion to the substrate may be adversely affected.

Whilst the main aspect of the present invention is the provision of beneficial unpigmented coatings in order to provide the advantages described herein, in one aspect of the invention various functional additives may be used in order to provide specific effects which enhance the security of a security document produced from the paper of this invnetion without significantly interfering with the general benefits provided by the unpigmented polyurethane coating. It will be understood by those skilled in the art that pigments are added to coatings, especially to paper coatings to provide colour or to opacify. In contrast the functional security additives which may be used in accordance with this invention are not pigments but are particulate materials which satisfy the following criteria:

a) the additive does not increase the opacity of the paper, once the coating is applied, by more than 1%. This ensures that the additive has no appreciable effect on the transparency of the coating and hence the general benefits of unpigmented coatings are retained;

b) the presence of the additive in the polyurethane coating does not cause failure of the tests which identify the polyurethane coating for this invention, namely the Koenig hardness test and the water-resistance test.

A functional additive in accordance with this invention is preferably a fluorescent or an irridescent pigment.

A security functional additive will provide some specific effect to enhance the security or recognisability of a document produced from paper in accordance with this invention and hence constitutes an additional security feature when such additive is present in the polyurethane coating. In general, security functional additives fall into three classes:

(a) publicly recognisable security features such as iridescent pigments;

(b) security features which provide higher levels of security and which are detectable with security equipment, such as fluorescent pigment, or magnetic particles; and (c) overt security features detectable by use of sophisticated detecting equipment such as may be used by central banks, e.g., phosphorescent pigments which possess unique decay times.

In general the coat weight of the polyurethane coating will be between 0.05 and 20 and preferably between 0.5 and 5 $g/m^2$.

Preferably, the polyurethane coating is applied to the paper immediately after a size bath squeeze roll and before the after-dryer when the paper is still wet with the size. However, the polyurethane may be applied, alternatively, to dry paper after completion of the steps of normal paper-making.

Preferably the polyurethane coating is applied to both sides of the paper.

The fibres which are present in the paper are natural or synthetic fibres or a mixture of natural and synthetic fibres.

The polyurethane is preferably of the aliphatic polyester type and is used in a dispersion with the dispersion having a polyurethane content in the range 2% to 70% by weight, and more preferably a polyurethane content in the range 5% to 30% by weight, although an aliphatic polyether type of polyurethane may alternatively be employed in the method of this invention. Also the polyurethane may be aliphatic polycarbonate polyurethane.

Preferably the paper used in the method is provided with as a security feature, a watermark or an embedded or windowed thread which incorporates visual or covert security elements.

In order to achieve the prime requirements of this invention, the coating comprising the polyurethane must be substantially transparent as explained herein, and preferably have a 100% modulus of greater than 4.0 mPa. It is desirable that the polyurethane coating has an ultimate tensile strength of greater than 40 mPa, for example from 40 to 80 mPa, as well as having a König hardness of greater than 20 seconds, for example from 20 to 40 seconds.

It is a completely new proposal to use in the manufacture of security paper, such as paper for the production of banknotes, an unpigmented polyurethane coating as described herein. The method of this invention provides security paper with several unexpected and useful properties:

a. The polyurethane coating, being free from fillers, is transparent; it does not therefore compromise visible security features present in the paper.

b. By reducing the surface porosity and roughness, the coating greatly increases the soil resistance of the paper. This is important to extend the circulation life of a banknote.

c. In contrast to b), the coating markedly improves the adhesion of print to the paper surface as evidenced by the wet and dry crumple, the wet rub and the laundry tests. This is most surprising as those skilled in the art would expect the use of the polyurethane coating of this invention to lead to poor print adhesion.

d. Unlike pigmented coatings, the polyurethane coatings herein described do not markedly alter the feel or appearance of the paper. This is important because the unusual visual and tactile properties of banknote paper assist the public in distinguishing counterfeits.

e. Furthermore, the coating enhances the definition and embossing of intaglio print.

f. The coating also prevents the uptake of optical brightening agents during accidental laundering. This is an immensely beneficial and unexpected property as the non-fluorescent nature of banknote paper also helps in the detection of counterfeits. It also prevents the fluorescence of optical brightening agents from obscuring any deliberate fluorescent security feature present in a banknote.

g. The coating does not affect the efficiency of the paper making converting or printing processes. In particular it does not block.

These properties resulting from the method of this invention are a consequence of the mechanical and chemical resistance and chemistry of the polyurethane coating in accordance with the water resistance test and the König hardness characteristics as defined previously. Materials failing to meet these two tests generally fail to meet the demanding specification expected of banknote paper.

The invention in another aspect provides a method of producing a security document wherein security paper is produced by a method as described herein and the resulting security paper is thereafter printed to form a security document. The term security document includes a banknote, an identification document, a driving licence and a sheet for a passport.

The following Examples illustrate the invention. In the Examples reference is made to certain standard tests which are now described or defined. Parts are parts by weight.

a) The Dry Crumple Test

A bank note sized sample of printed paper is manually crumpled and flattened 10 times according to a standard technique. The printed sample is then examined and an assessment of ink loss is made.

b) The Wet Crumple Test

As for the dry crumple test but the paper is wetted before each crumple.

c) The Sheen Wet Rub Test

A bank note sized sample of printed paper is subjected to 300 rubs applied by an 800 g weighted brush driven by the Sheen rub tester. The amount of ink lost during the test is visually assessed.

d) The Severe Laundry Test

A banknote sized sample of printed paper is boiled in solution containing 5 parts of a domestic washing powder and 10 parts sodium carbonate for 30 minutes.

The sample is then rinsed under cold water. The amount of ink loss is then assessed visually.

e) The FIRA Soil Test

A sample of the printed paper is placed at one end of a cylinder along with a reference sample placed at the opposite end and 20 felt cubes impregnated with artificial sweat and colloidal graphite. The cylinder is rotated in alternate directions for a period of 30 minutes. The change in reflectance of the printed samples is measured and the relative soil pickup is calculated by comparing the results of the test.

EXAMPLE 1

A sheet of paper was produced on a paper machine from an aqueous suspension of cellulose fibres, optionally mixed with synthetic fibres or mineral fillers or other additives used in the paper industry. The paper was then dried, sized, dried a second time and reeled.

A coating formulation was made consisting of:

15 parts: Aliphatic polyester polyurethane (Witocobond $_{785}$™) supplied by Baxenden Applied Chemicals Limited.

85 parts: water

The reeled sized paper was unreeled and the coating was applied to both sides of the paper using a Meyer bar coater and dried, thereby giving a paper coating of 2 g/m$^2$ on both sides.

The coated paper was then finished in the usual way, being calendered and cut.

The coated paper was then printed by both intaglio and offset methods.

A sample of the coating formulation was tested using the water resistance test described above and the König Hardness test. The coating was found to have a König Hardness of 100 secs. The coating was also found to have good water resistance.

Both coated and uncoated printed paper were tested using the wet crumple test, the dry crumple test, the severe laundry test, the FIRA soil test and the Sheen wet rub test. When compared to uncoated paper from the same papermaking batch, the coated samples yielded the following results for each test:

Wet crumple test: Markedly less ink loss.

Dry crumple test: Noticeably less ink loss.

Severe laundry test: Almost no observable ink loss compared to over 80% loss in the case of the uncoated paper.

Wet rub test: Uncoated paper over 50% of a printed area was lost; polyurethane-coated paper, less than 10% of the printed area was lost.

FIRA Soil test: 30% less soil pick-up.

Examination of the laundered samples under UV light showed that the coated samples picked up an imperceptibly small amount of optical brightening agent, unlike the uncoated samples which became markedly fluorescent after the laundry process.

The intaglio print on both the coated and uncoated samples was examined. The uncoated paper showed characteristic feathering expected from banknote paper. The coated paper showed markedly less feathering.

EXAMPLE 2

A sheet of paper was produced on a paper machine from an aqueous suspension of cellulose fibres, optionally mixed with synthetic fibres or mineral fillers or other additives used in the paper industry. The paper was then dried, sized, dried a second time and reeled.

A coating formulation was made consisting of:

7.5 parts: Aliphatic polyester polyurethane (Witocobond 785™) supplied by Baxenden Applied Chemicals Limited.

7.5 parts: Vinyl Acetate—VeoVa copolymer (Vinamul 6975™) supplied by Vinamul Limited.

0.5 parts: Polyaziridine (CX100™) supplied by Zeneca Resins BV.

84.5 parts: water

The reeled sized paper was unreeled and the coating was applied to both sides of the paper using a Meyer bar coater and dried, thereby giving a paper coating of 2 g/m$^2$ on both sides.

The coated paper was next calendered and cut in the usual way.

The coated paper was then printed by both intaglio and offset methods.

A sample of the coating formulation was tested using the water resistance described above and the König Hardness test. The coating had a König Hardness of 120 secs. The polyurethane coating was found to have good water resistance.

Both coated and uncoated printed paper were tested using the wet crumple test, the dry crumple test, the severe laundry test, the FIRA soil test and the wet rub test. The resulting paper possessed essentially the same properties as those reported for the paper produced by the method of Example 1 with respect to the wet crumple test, etc.

Examination of the laundered samples under UV light showed that the coated samples picked up an imperceptibly small amount of optical brightening agent, unlike the uncoated samples that became markedly fluorescent after the laundry process.

The intaglio print on both the coated and uncoated samples was examined. The uncoated paper showed the characteristic feathering expected from banknote paper. The coated paper showed markedly less feathering.

EXAMPLE 3

A sheet of paper was produced on a paper machine from an aqueous suspension of cellulose fibres, optionally mixed with synthetic fibres or mineral fillers or other additives used in the paper industry. The paper was then dried, sized, dried a second time and reeled.

A coating formulation was made consisting of:

10.5 parts: Aliphatic polyester polyurethane (Witocobond 779™) supplied by Baxenden Applied Chemicals Limited.

4.5 parts: Anionic styrene-acrylate copolymer (Vinamul 7172™) supplied by Vinamul Limited.

0.5 parts: Polyaziridine (CX100™) supplied by Zeneca Resins BV.

84.5 parts: water

The reeled sized paper was unreeled and the coating was applied to both sides of the paper using Meyer bar coater and dried, thereby giving a paper coating of 2 g/m$^2$ on both sides.

The coated paper was next calendered and cut in the usual way.

The coated paper was then printed on both intaglio and offset methods.

A sample of the coating formulation was tested using the water resistance test described above and the König Hardness test. The coating had a König Hardness of 80 secs. The coating was also found to have good water resistance.

Both coated and uncoated printed paper were tested using the wet crumple test, the dry crumple test, the severe laundry test, the FIRA soil test and the Sheen wet rub test. The resulting paper possessed essentially the same properties as those reported for the paper produced by the method of Example 1 with respect to the wet crumple test, etc.

Examination of the laundered samples under UV light showed that the coated samples picked up an imperceptibly small amount of optical brightening agent, unlike the uncoated samples that became markedly fluorescent after the laundry process.

The intaglio print on both the coated and uncoated samples was examined. The uncoated paper showed the characteristic feathering expected from banknote paper. The coated paper showed markedly less feathering.

EXAMPLE 4

A sheet of paper was produced on a paper machine from an aqueous suspension of cellulose fibres, optionally mixed with synthetic fibres or mineral fillers or other additives used in the paper industry. The paper was then dried, sized, dried a second time and reeled.

A coating formulation was made consisting of:

15 parts: Aliphatic polyester-polycarbonate polyurethane (IR140™) supplied by Industrial Copolymers Limited.

0.5 parts: Polyaziridine (CX100™) supplied by Zeneca Resins BV.

84.5 parts: water

The reeled sized paper was unreeled and the coating was applied to both sides of the paper using a Meyer bar coater and dried thereby giving a paper coating of 2 g/m$^2$ on both sides.

The coated paper was next calendered and cut in the usual way.

The coated paper was then printed by both intaglio and offset methods.

A sample of the coating formulation was tested using the water resistance described above and the König Hardness test. The coating had a König Hardness of 120 secs. The coating is also found to have good water resistance.

Both coated and uncoated printed paper were tested using the wet crumple test, the dry crumple test, the severe laundry test, the FIRA soil test and the Sheen wet rub test. The resulting paper possessed essentially the same properties as those reported for the paper produced by the method of Example 1 with respect to the wet crumple test, etc.

Examination of the laundered samples under UV light showed that the coated samples picked up an imperceptibly small amount of optical brightening agent, unlike the uncoated samples that became markedly fluorescent after the laundry process.

The intaglio print on both the coated and uncoated samples was examined. The uncoated paper showed the characteristic feathering expected from banknote paper. The coated paper showed markedly less feathering.

EXAMPLE 5

A sheet of paper was produced on a paper machine from an aqueous suspension of cellulose fibres, optionally mixed with synthetic fibres or mineral fillers or other additives used in the paper industry. The paper was dried and the size solution was applied.

A coating formulation was made consisting of:

15 parts: Aliphatic polyester-polycarbonate polyurethane (IR140™) supplied by Industrial Copolymers Limited.

0.5 parts: Polyaziridine (CX100™) supplied by Zeneca Resins BV.

84.5 parts: water

The coating was applied to both sides of the wet sized paper after a size bath squeeze roll using a Meyer bar coater and dried, thereby giving a paper coating of 2 g/m$^2$ on both sides. This procedure provided an economic advantage in that a drying step has been eliminated.

The coated paper was next dried and reeled.

The coated paper was next calendered and cut in the usual way.

The coated paper was next printed on both intaglio and offset methods.

A sample of the coating formulation was tested using the water resistance test and the König Hardness test. The coating had a König Hardness of 120 secs. The coating was also found to have good water resistance.

Both coated and uncoated printed paper were tested using the wet crumple test, the dry crumple test, the severe laundry test, the FIRA soil test and the Sheen wet rub test. The resulting paper possessed essentially the same properties as those reported for the paper produced by the method of Example 1 with respect to the wet crumple test, etc.

Examination of the laundered samples under UV light showed that the coated samples picked up an imperceptibly small amount of optical brightening agent, unlike the uncoated samples which become markedly fluorescent after the laundry process.

The intaglio print on both the coated and uncoated samples was examined. The uncoated paper showed the characteristic feathering expected from banknote paper. The coated paper showed markedly less feathering when printed with ink to form a security document such as a banknote.

All of the papers produced by each of Examples 1 to 5 had a water resistant coating as determined by criteria (i), (ii) and (iii) set out above. Specifically, (i) the wet tensile strength and Young's Modulus showed no loss; (ii) there was no visible loss of transparency and (iii) there was no change in the weight of the film.

For purposes of comparison there is now given an example which shows the typical strength from a coating with inadequate water resistance and mechanical strength.

EXAMPLE A

A sheet of paper was produced on a paper machine from an aqueous suspension of cellulose fibres, optionally mixed with synthetic fibres or mineral fillers or other additives used in the paper industry. The paper was dried, sized, dried a second time and reeled.

A coating formulation was made consisting of:

15 parts: Aliphatic polyester polyurethane (Witocobond 290H™) supplied by Baxenden Applied Chemicals Limited.

84.5 parts: water

The reeled sized paper was unreeled and the coating was applied to both sides of the paper using a Meyer bar coater and dried thereby giving a paper coating of $2g/m^2$ on both sides.

The paper was next calendered and cut in the usual way.

The paper was next printed by both intaglio and offset methods.

A sample of the coating formulation was tested using the water resistance test described above and the König Hardness test. The coating had a König Hardness of 15 secs. The coating was also found not to have good water resistance.

Both coated and uncoated printed paper was tested using the FIRA soil test. The results showed that the soil resistance of the coated paper was markedly better than the uncoated paper.

Both coated and uncoated printed paper was tested using the wet crumple test, the dry crumple test, the severe laundry test and the Sheen wet rub test. When compared to samples of uncoated paper from the same paper making batch the coated samples are markedly inferior.

The Intaglio print on both the coated and uncoated samples was examined. The uncoated paper showed the characteristic feathering expected from banknote paper. The coated paper showed markedly less feathering.

As is shown above by the various tests in the Examples 1 to 5, the paper was produced in accordance with the method of this invention has significantly improved properties relative the standard banknote paper.

Good print adhesion is evidenced by the wet crumple test, the dry crumple test, the wet rub test and severe laundry tests. Also, print definition with paper according to this invention is significantly better than that obtained using traditional banknote paper. Furthermore Intaglio print in particular is better defined, and also Intaglio embossing is improved. Also excellent soil resistance means that the coated paper produced by the method of this invention attracted less than two-thirds of the soiling medium compared to uncoated paper.

As indicated above, extenders can be used in the formulation of the coating in order to reduce the cost; they may also impart useful properties such as improved adhesion of surface applied security features, such as holograms.

Extenders which may be used in accordance with this invention are typically dispersions of water insoluble binders such as styrene/acrylic copolymers, acrylated vinyl acetate, vinyl chloride/ethylene copolymers, or vinyl acetate copolymers. They are generally unable to withstand both the water-resistance and hardness tests.

An alternative extender is a VA/VEOVA copolymer, for example that sold under the trade name Vinamul 6975™.

However, in combination with a suitable polyurethane, they function satisfactorily in terms of the criteria previously set out, provided that the composition comprising the polyurethane and the extender possess the specified König Hardness and pass the water-resistance test.

The extenders may be added at levels up to 70, preferably from 15 to 50, parts in 100 parts of the coating formulation. The strongest and most water-resistant extenders can be added at this level. Weaker and less water-resistant extenders clearly can not be added at such high levels bearing in mind the properties specified for the coating composition.

Crosslinking agents can be used to increase the water-resistance and hardness of the polyurethane coating. They can be used to obtain the required properties from polyurethanes which would otherwise be unsuitable. They can also improve the properties of the polyurethane component thereby enabling greater quantities of extender to be used. Suitable crosslinking agents include polyaziridine, carbodiimide, isocyanate and zirconium salts. Other crosslinkers such as epoxy resin may be used but are less practical due to their high cure temperatures or long cure times.

Furthermore, further investigations have indicated that the polyurethane coatings in accordance with this invention provide a significant additional benefit. The use of the particular polyurethane coatings have been found to enhance the durability and optical effects of foils, holograms, kinograms and the like. This is because the polyurethane coating reduces significantly the extent to which the adhesive used in affixing foils including holograms, is absorbed into the paper surface. It has been found that the adhesive may be used more evently and this results in better adhesion and a more glossy surface. The more glossy surface which is obtained is especially beneficial for holograms as the visual detail present in the hologram is significantly clearer to the viewer. As is well known, holograms are generally expensive and it is of undoubted commercial benefit that they will stay in place for a longer period when a security document such as a banknote is in circulation, and this is a consequence of the enhanced durability provided by the polyurethane coating in accordance with this invention.

We claim:

1. A method for producing security paper which includes a security feature, which method comprises:

(1) supplying paper-making fibres to a paper-machine;

(2) incorporating into the paper during its manufacture at least one security feature and producing paper;

(3) applying to the resulting paper a sizing agent to size the paper; (4) selecting a substantially transparent coating composition comprising an unpigmented polyurethane which may optionally comprise a functional additive provided that the presence of the functional additive does not increase the opacity of the resulting paper by more than 1% wherein said coating composition being such as to provide a film, when cast on a glass surface, having a König hardness of from 15 to 130 seconds, and also passing the water resistance test as defined by the following steps:

(a) the total formulation to be used in the coating is cast on a glass plate so as to produce a film with a dry weight of 80 $g/m^2$;

(b) the film is initially dried at 23° C. Once it is tack free it is dried for an additional hour at 80° C.;

(c) the film is weighed before being wetted and tested for tensile strength, Young's Modulus and is visually checked for any change in its transparency;

(d) a sample of the film is boiled in water containing 10 g/litre $Na_2CO_3$ for 30 mins;

(e) the film in then rinsed in cold water and the steps b) to c) are then repeated;

wherein when the film is dried and re-weighed the film meets the following criteria:

i) the wet tensile strength and Young's Modulus of the boiled film is not less than 90% of the initial film wet tensile strength and Young's Modulus;

ii) the film shows no perceptible loss of transparency, and iii) the dried weight of the film is not less than 98% of the original weight;

(5) applying the selected coating composition to one or both sides of the sized paper;

(6) and thereafter drying the paper to produce the said security paper.

2. A method as claimed in claim 1, wherein the polyurethane is in the form of an aqueous dispersion.

3. A method as claimed in claim 1, wherein the coating also comprises an extender.

4. A method as claimed in claim 3, wherein the extender is a polyacrylate.

5. A method as claimed in claim 1, wherein the coat weight of the coating comprising the polyurethane is between 0.05 and 20 grams per square meter.

6. A method as claimed in claim 5, wherein the coating weight is between 0.5 and 5 grams per square meter.

7. A method as claimed in claim 1, wherein the coating comprising the polyurethane is applied to the paper immediately after sizing while the paper is still wet.

8. A method as claimed in claim 1, wherein the coating comprising the polyurethane is applied to dry paper after completion of the steps of normal papermaking, wherein the steps of normal papermaking comprise forming the paper, wet pressing the paper, drying the paper, calendering the paper and winding the paper as finished paper.

9. A method as claimed in claim 1, wherein the fibres which are present in the paper are natural or synthetic fibres or a mixture of natural and synthetic fibres.

10. A method as claimed in claim 1, wherein the polyuerethane is of the aliphatic polyester type and is used in a dispersion with the dispersion having a polyurethane content in the range 2% to 70% by weight.

11. A method as claimed in claim 10, wherein the dispersion has a polyurethane content in the range 5% to 30% by weight.

12. A method as claimed in claim 10, wherein the polyurethane is cross-linkable and is cross-linked during drying of the paper.

13. A method as claimed in claim 12 wherein the cross-linking is effected using an aziridine as a cross-linking agent.

14. A method as claimed in claim 1, wherein the security feature is a watermark, or an embedded thread which thread may incorporate visual or covert security elements.

15. A method as claimed in claim 1, wherein the coating composition comprises a functional additive which is a fluorescent or iridescent additive.

16. A method of producing a security document wherein security paper is produced by a method as claimed in claim 1, and thereafter the resulting security paper is printed to form the security document.

17. A method as claimed in claim 16, wherein a foil including a plain foil, a hologram or a kinogram is affixed to the security paper before or after the printing.

18. A method as claimed in claim 16, wherein said security paper is a banknote.

* * * * *